US010726791B2

(12) United States Patent
Tamura

(10) Patent No.: US 10,726,791 B2
(45) Date of Patent: Jul. 28, 2020

(54) ELECTRO-OPTICAL DEVICE AND ELECTRONIC APPARATUS

(71) Applicant: SEIKO EPSON CORPORATION, Tokyo (JP)

(72) Inventor: Tsuyoshi Tamura, Hara-Mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/256,008

(22) Filed: Jan. 24, 2019

(65) Prior Publication Data

US 2019/0228714 A1 Jul. 25, 2019

(30) Foreign Application Priority Data

Jan. 25, 2018 (JP) ..... 2018-010421

(51) Int. Cl.
*G09G 3/3291* (2016.01)
*G09G 3/3233* (2016.01)
*G09G 3/3266* (2016.01)

(52) U.S. Cl.
CPC ..... *G09G 3/3291* (2013.01); *G09G 3/3233* (2013.01); *G09G 3/3266* (2013.01); *G09G 2300/0421* (2013.01); *G09G 2300/0842* (2013.01); *G09G 2320/041* (2013.01); *G09G 2330/021* (2013.01)

(58) Field of Classification Search
CPC .. G09G 3/3291; G09G 3/3233; G09G 3/3266; G09G 2300/0421; G09G 2300/0482; G09G 2320/041; G09G 2330/021
USPC ..... 345/82
See application file for complete search history.

(56) References Cited

U.S. PATENT DOCUMENTS 4,739,320 A * 4/1988 Dolinar ..... G09G 3/30 345/212
2003/0201991 A1 10/2003 Goto et al.
2004/0061694 A1 4/2004 Noguchi et al.
2004/0149886 A1* 8/2004 Matsueda ..... G09G 3/3233 250/208.1
2008/0252577 A1 10/2008 Goto et al.
2009/0289931 A1 11/2009 Matsueda et al.
(Continued)

FOREIGN PATENT DOCUMENTS

JP 10010572 A * 1/1998
JP 2003-316328 A 11/2003
(Continued)

*Primary Examiner* — Mark Edwards
(74) *Attorney, Agent, or Firm* — Oliff PLC

(57) ABSTRACT

An electro-optical device includes a display unit provided with a first pixel circuit connected to a first data line, a second pixel circuit connected to a second data line, a third pixel circuit connected to a third data line, and a fourth pixel circuit connected to a fourth data line, a first data line driving circuit configured to supply a gradation signal to the first data line and the second data line, and a second data line driving circuit configured to supply a gradation signal to the third data line and the fourth data line. The first data line driving circuit and the second data line driving circuit are arranged to sandwich the display unit in a wiring direction of the first data line. A layout of the first data line driving circuit and a layout of the second data line driving circuit are in line symmetry.

8 Claims, 4 Drawing Sheets

(56) References Cited

U.S. PATENT DOCUMENTS

| | | | |
|---|---|---|---|
| 2011/0141084 | A1 | 6/2011 | Kishi |
| 2014/0028541 | A1 | 1/2014 | Truong et al. |
| 2017/0244970 | A1 | 8/2017 | Tamura et al. |
| 2017/0249885 | A1 | 8/2017 | Tamura |
| 2017/0372658 | A1 | 12/2017 | Tamura |

FOREIGN PATENT DOCUMENTS

| | | | |
|---|---|---|---|
| JP | 2004-118015 | A | 4/2004 |
| JP | 2004-133411 | A | 4/2004 |
| JP | 2009-288668 | A | 12/2009 |
| JP | 2013-148751 | A | 8/2013 |
| JP | 2013-160872 | A | 8/2013 |
| JP | 2014-186084 | A | 10/2014 |
| JP | 2014-186125 | A | 10/2014 |
| JP | 2015-114399 | A | 6/2015 |
| JP | 2016-009112 | A | 1/2016 |
| JP | 2017-146535 | A | 8/2017 |
| JP | 2017-151284 | A | 8/2017 |
| JP | 2018-004720 | A | 1/2018 |
| WO | 2010/029795 | A1 | 3/2010 |

* cited by examiner

ELECTRO-OPTICAL DEVICE AND ELECTRONIC APPARATUS

BACKGROUND

1. Technical Field

The present invention relates to an electro-optical device and an electronic apparatus.

2. Related Art

An electro-optical device including a display unit in which pixel circuits are arranged in a matrix corresponding to positions of pixels where scanning lines and data lines intersect with each other has been widespread. The pixel circuit includes a light-emitting element such as an Organic Light-emitting Diode (OLED), a transistor, and the like. In addition, a Si-OLED in which a driving circuit and the like configured to perform drive control of the display unit is mounted on a silicon backplane has also been developed. As specific examples of the driving circuit configured to perform drive control of the display unit include a scanning line driving circuit configured to perform vertical scanning of the display unit, and a data line driving circuit configured to perform display gradation control of each pixel circuit belonging to the selected scanning line.

Data line driving circuits in the related art are generally arranged along one side in a wiring direction of the scanning line of the display unit (hereinafter, a row direction or a left-right direction), and the scanning line driving circuits are generally arranged along one side in a wiring direction of the data line (hereinafter, a column direction or an upper-lower direction). In a high-definition electro-optical device having a resolution exceeding 1080 pixels, the pitch of the pixel circuits arranged in the display unit tends to decrease. As the pitch of the pixel circuits decreases, it is necessary to consider the influence of a wiring pitch, an arrangement pitch of transistors configuring the data line driving circuit, an arrangement pitch of capacitors configured to hold the gradation voltage corresponding to the display gradation, and a cell pitch of amplifiers configured to amplify the gradation voltage or Digital to Analog Converter (DAC) on the display quality. Furthermore, it is difficult to provide the data line driving circuits along one side in the row direction of the display unit due to various factors such as the data acquisition speed indicating the gradation voltage, the display frame frequency, and the like. Therefore, an aspect in which the data line driving circuits are arranged on the upper and lower sides of the display unit, and the scanning line driving circuits are arranged on the left and right sides of the display unit has been proposed (for example, see JP-A-2016-009112, and JP-A-2004-118015).

However, in an aspect in which the data line driving circuits are arranged on the upper and lower sides of the display unit, there is a problem that long design period is needed in individual designing of each data line driving circuit arranged upper and lower, a control unit configured to perform drive control of data line driving circuits, and a layout of I/O terminals. In addition, in an aspect in which each data line driving circuit arranged upper and lower, the control unit configured to perform drive control of the data line driving circuits, and the layout of the I/O terminals are designed individually, there is a problem that display unevenness easily occurs due to differences of the characteristics of the upper and lower circuits.

SUMMARY

To resolve the problems above, an electro-optical device includes a display unit provided with a first pixel circuit connected to a first data line, a second pixel circuit connected to a second data line, a third pixel circuit connected to a third data line, and a fourth pixel circuit connected to a fourth data line, a first data line driving circuit configured to supply a gradation signal corresponding to a display gradation to the first data line and the second data line, and a second data line driving circuit configured to supply a gradation signal corresponding to a display gradation to the third data line and the fourth data line, wherein the first data line driving circuit and the second data line driving circuit are arranged to sandwich the display unit in a wiring direction of the first data line, and a layout of the first data line driving circuit and a layout of the second data line driving circuit are in line symmetry.

According to this aspect, the first and second data line driving circuits are provided on the upper and lower sides by interposing the display unit, thus, the electro-optical device can be reduced in size and increased in definition. The first data line driving circuit and the second data line driving circuit are laid out in line symmetry to each other, thus, it is not necessary to individually design and verify the first data line driving circuit and the second data line driving circuit, and a compact electro-optical device capable of displaying a high-definition image without causing a significant increase in design man-hours can be developed. In addition, according to this aspect, it is not necessary to individually design the first data line driving circuit and the second data line driving circuit, thus, no differences of the characteristics of the first data line driving circuit and the second data line driving circuit occurs, and display unevenness hardly occurs.

The electro-optical device described above may include a first connection unit that connects the first data line and the second data line with the first data line driving circuit, and a second connection unit that connects the third data line and the fourth data line with the second data line driving circuit, wherein a layout of the first connection unit and a layout of the second connection unit are not in line symmetry.

In a case where the first pixel circuit and the second pixel circuit as well as the third pixel circuit and the fourth pixel circuit are arranged not in line symmetry to the display unit, it is difficult to lay out the first data line driving circuit and the second data line driving circuit in line symmetry including a wiring to each pixel circuit. However, according to this aspect, the asymmetry of the wiring to each pixel circuit is reflected in the first connection unit and the second connection unit, thus, the first data line driving circuit and the second data line driving circuit can be reliably laid out in line symmetry.

The electro-optical device described above may include a first power source configured to supply an operating voltage to the first data line driving circuit, and a second power source configured to supply an operating voltage to the second data line driving circuit, wherein the first power source and the second power source are arranged to sandwich the display unit in the wiring direction of the first data line, and a layout of the first power source and a layout of the second power source are in line symmetry.

According to this aspect, in a case where the pixel circuit to which the gradation signal is supplied from the first data line driving circuit and the pixel circuit to which the gradation signal is supplied from the second data line driving circuit are arranged in the same column on the display unit, the distance from the first power source to the column and the distance from the second power source to the column are substantially equal to each other, and the display unevenness hardly occurs.

Further, in addition to the electro-optical device, the present invention can be conceived as an electronic apparatus including the electro-optical device. The electronic apparatuses, typically include electro-optical device such as a head-mounted display (HMD) or an electronic viewfinder.

BRIEF DESCRIPTION OF THE DRAWINGS

The present invention will be described with reference to the accompanying drawings, wherein like numbers reference like elements.

DESCRIPTION OF EXEMPLARY EMBODIMENTS

Hereinafter, exemplary embodiments for carrying out the present invention will be described with reference to accompanying drawings. However, in each drawing, a size and scale of each unit is different from the actual size and scale of each unit as appropriate. In addition, exemplary embodiments described below are desirable specific examples of the present invention, and various technically preferred limitations are applied, but the scope of the present invention is not limited to these exemplary embodiments unless a description to the effect that the present invention is specifically limited is made in the explanation below.

A. Exemplary Embodiment

Figure 1:
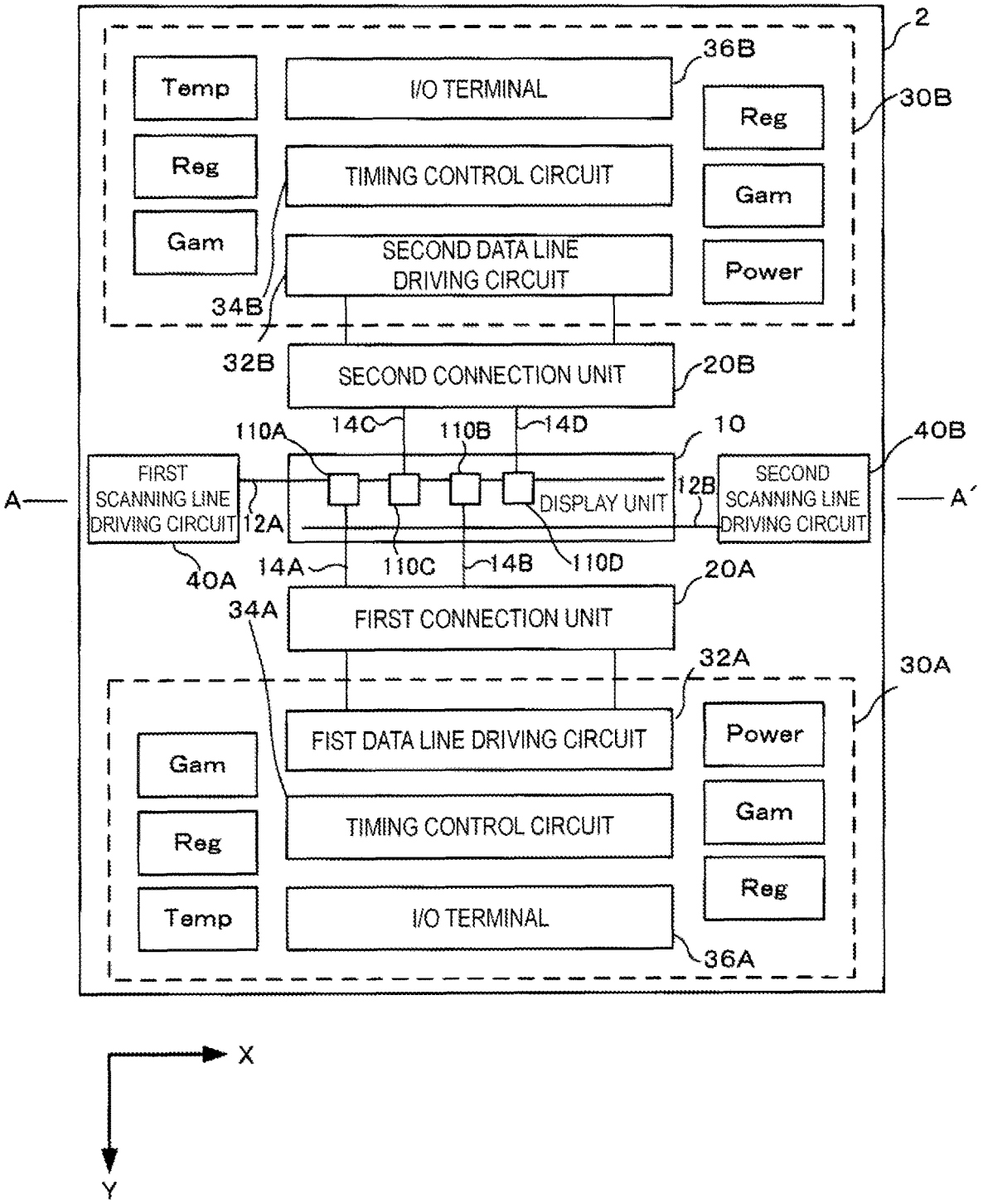
FIG. 1 is a diagram illustrating a configuration example of the silicon backplane 2 of the electro-optical device according to the present invention.

FIG. 1 is a diagram illustrating a configuration of a silicon backplane 2 of an electro-optical device according to one exemplary embodiment of the present invention. As illustrated in FIG. 1, the silicon backplane 2 is provided with a display unit 10, a first connection unit 20A, a second connection unit 20B, a first circuit region 30A, a second circuit region 30B, a first scanning line driving circuit 40A, and a second scanning line driving circuit 40B.

The display unit 10 is formed in a rectangular shape whose length in a Y direction is longer than the length in an X direction. Although detailed illustration is omitted in FIG. 1, in the display unit 10, 3N (N is a natural number equal to or greater than 2) data lines extending in the Y direction are laid out at equal intervals in the X direction, and M (M is a natural number equal to or greater than 2) scanning lines extending in the X direction are laid out at equal intervals in the Y direction. In FIG. 1, four lines of a first data line 14A, a second data line 14B, a third data line 14C, and a fourth data line 14D are illustrated as a representative of the 3N data lines. Further, in FIG. 1, two lines of a first scanning line 12A and a second scanning line 12B are illustrated as a representative of the M scanning lines. The display unit 10 has a so-called 2K 2K resolution, specifically, N=1920 and M=2160. Further, the vertical scanning frequency of the display unit 10 is 90 Hz.

The display unit 10 is provided with pixel circuits corresponding to intersections of data lines and scanning lines. M scanning lines and 3N data lines are laid on the display unit 10, thus, the display unit 10 has M×3N pixel circuits. In FIG. 1, among the M×3N pixel circuits included in the display unit 10, four pixel circuits of a first pixel circuit 110A, a second pixel circuit 110B, a third pixel circuit 110C, and a fourth pixel circuit 110D are illustrated. As illustrated in FIG. 1, the first pixel circuit 110A is provided at the intersection of the first scanning line 12A and the first data line 14A, the second pixel circuit 110B is provided at the intersection of the first scanning line 12A and the second data line 14B, the third pixel circuit 110C is provided at the intersection of the first scanning line 12A and the third data line 14C, and the fourth pixel circuit 110D is provided at the intersection of the first scanning line 12A and the fourth data line 14D, respectively.

Although detailed illustration is omitted in FIG. 1, a pixel circuit with a red (R) emission color is provided at the intersection of the (3n−2) th (n=1 to N) data line from the left side of the display unit 10 and the m th (m=1 to M) scanning line from the upper side of the display unit 10. A pixel circuit with a green (G) emission color is provided at the intersection of the (3n−1) th (n=1 to N) data line from the left side of the display unit 10 and the m th (m=1 to M) scanning line from the upper side of the display unit 10. And, a pixel circuit with a blue (B) emission color is provided at the intersection of the 3n th (n=1 to N) data line from the left side of the display unit 10 and the m th (m=1 to M) scanning line from the upper side of the display unit 10. The first data line 14A in FIG. 1 is any one of the (3n−2) th (n=1 to N) data lines, and the third data line 14C is any one of the (3n−1) th (n=1 to N) data lines. And, each of the second data line 14B and the fourth data line 14D is any one of the 3n th (n=1 to N) data lines. That is, the first pixel circuit 110A is the pixel circuit with a red emission color, and the third pixel circuit 110C is the pixel circuit with a green emission color. Each of the second pixel circuit 110B and the fourth pixel circuit 110D is the pixel circuit with a blue emission color. The pixel circuit included in the display unit 10 includes a light emitting element such as an OLED, and a transistor configured to supply a current corresponding to a gradation signal supplied via the data line to the light emitting element. In the present exemplary embodiment, one dot of a color image is expressed by three pixel circuits corresponding to the scanning lines in the same row and each of the (3n−2) th, the (3n−1) th and the 3n th data lines. That is, in the present exemplary embodiment, it is configured to express the color of one dot by additive color mixture by light emission of the OLED corresponding to RGB.

The first connection unit 20A and the second connection unit 20B are provided to interpose the display unit 10 in the Y direction. The first circuit region 30A and the second circuit region 30B are provided to interpose the first connection unit 20A, the display unit 10, and the second connection unit 20B in the Y direction. The first scanning line driving circuit 40A and the second scanning line driving circuit 40B are provided to interpose the display unit 10 in the X direction.

The first scanning line driving circuit 40A is a circuit that sequentially selects odd-numbered scanning lines among the M scanning lines in order from the top in one vertical scanning period, and the second scanning line driving circuit 40B is a circuit that sequentially selects even-numbered scanning lines among the M scanning lines in order from the top. In one vertical scanning period, the first scanning line driving circuit 40A and the second scanning line driving circuit 40B alternately select the scanning lines. As illustrated in FIG. 1, the first scanning line 12A is connected to the first scanning line driving circuit 40A, and the second scanning line 12B is connected to the second scanning line driving circuit 40B. That is, the first scanning line 12A is any one of the odd-numbered scanning lines among the M scanning lines, and the second scanning line 12B is any one of the even-numbered scanning lines among the M scanning lines. Since the configurations of the first scanning line driving circuit 40A and the second scanning line driving circuit 40B are not particularly different from the configurations of the scanning line driving circuit of the electro-optical device in the related art, detailed description will be omitted. In the present exemplary embodiment, although the odd-numbered scanning lines are connected to the first scanning line driving circuit 40A and the even-numbered scanning lines are connected to the second scanning line driving circuit 40B, but it is not limited to this aspect. For example, it may be an aspect that the scanning lines are divided into two in the left-right direction (the X direction in FIG. 1), each of the left scanning lines is connected to the first scanning line driving circuit 40A, and each of the right scanning lines is connected to the second scanning line driving circuit 40B, that is, an aspect in which the pixel circuits for one row are selected from left and right by the first scanning line driving circuit 40A and the second scanning line driving circuit 40B.

In the first circuit region 30A, the first data line driving circuit 32A that supplies a gradation signal corresponding to the display gradation to the pixel circuit via the data line, a timing control circuit 34A, an I/O terminal 36A, and other peripheral circuits are arranged. In a second circuit region 30B, a second data line driving circuit 32B that supplies the gradation signal corresponding to the display gradation to the pixel circuit via the data line, a timing control circuit 34B, an I/O terminal 36B, and other peripheral circuits are arranged.

In FIG. 1, as an example of the other peripheral circuits, a temperature sensor that detects a temperature around the display unit 10, a power source configured to generate a gradation voltage, a resistance and a buffer configured for the generation of gradation voltage, and a built-in power source that supplies an operating voltage to each circuit in the first circuit region 30A are illustrated. The built-in power source arranged in the first circuit region 30A is a first power source that supplies operating power to the first data line driving circuit 32A, and the built-in power source arranged in the second circuit region 30B is a second power source that supplies operating power to the second data line driving circuit 32B. Note that, in FIG. 1, the temperature sensor is denoted as "Temp", the gradation voltage generating power source is denoted as "Reg", both the gradation voltage generating resistor and the buffer are collectively denoted as "Gam", and the built-in power source is denoted as "Power". Note that, either one of the temperature sensor arranged in the first circuit region 30A or the temperature sensor arranged in the second circuit region 30B may be used, or both may be used. As an aspect in which both the temperature sensor arranged in the first circuit region 30A and the temperature sensor arranged in the second circuit region 30B are used, an aspect in which the average value of the detection values of both sensors is taken as the temperature around the display unit 10 is considered.

The first data line driving circuit 32A is a circuit that supplies a gradation signal corresponding to the display gradation to half of the pixel circuit with blue display color and the pixel circuit with red display color among the pixel circuits arranged in the display unit 10 via the data lines. Specifically, the first data line driving circuit 32A supplies the gradation signal to the first pixel circuit 110A via the first data line 14A, and supplies the gradation signal to the second pixel circuit 110B via the second data line 14B. Hereinafter, a group of half of the pixel circuits with blue display color and the pixel circuit with red display color among the pixel circuits arranged in the display unit 10 is referred to as a first group. The second data line driving circuit 32B is a circuit that supplies a gradation signal corresponding to the display gradation to the pixel circuits belonging to a second group different from the first group among the pixel circuits arranged in the display unit 10 (that is, the other half of the pixel circuit with blue display color and the pixel circuit with green display color) via the data lines. The second data line driving circuit 32B supplies the gradation signal to the third pixel circuit 110C via the third data line 14C and also supplies the gradation signal to the fourth pixel circuit 110D via the fourth data line 14D.

Since the configurations of the first data line driving circuit 32A and the second data line driving circuit 32B are the same, only the configuration of the first data line driving circuit 32A will be described below. Similarly, since the configurations of the timing control circuit 34A and the timing control circuit 34B are the same, only the configuration of the timing control circuit 34A will be described below.

Figure 2:
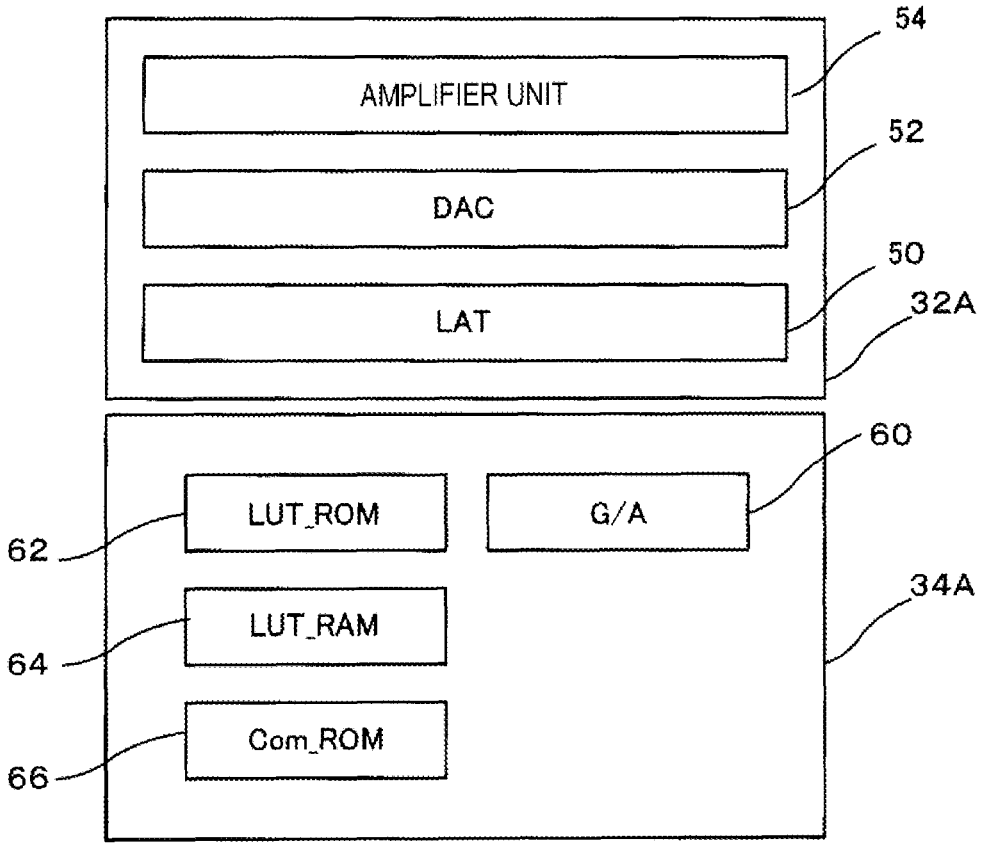
FIG. 2 is a diagram illustrating a configuration example of the first data line driving circuit 32A and the timing control circuit 34A.

FIG. 2 is a diagram illustrating a configuration example of the first data line driving circuit 32A and the timing control circuit 34A. As illustrated in FIG. 2, the first data line driving circuit 32A includes a data latch unit (illustrated as "LAT" in FIG. 2) 50 that acquires a gradation data representing the display gradation of a pixel, a gradation voltage selection unit (illustrated as "DAC" in FIG. 2) 52 that selects a gradation voltage corresponding to the gradation data, and an amplifier unit 54 that amplifies an output voltage of the gradation voltage selection unit 52 and outputs it as a gradation signal. The amplifier unit 54 includes a number of amplifiers corresponding to the number of pixel circuits arranged in the scanning line direction.

As described above, the vertical scanning frequency of the electro-optical device of the present exemplary embodiment is 90 Hz and M=2160, thus, the one horizontal scanning period is 1=90=2200=5 μs. The estimation of the horizontal scanning period is set to 2200 instead of 2160 because the blanking period was calculated for 40 lines. Assuming that the operation time of each of the plurality of amplifiers included in the amplifier unit 54 is 500 ns, each of the amplifiers described above can output nine times in the period of 5 μs. 1920×3 pixel circuits are arranged in the scanning line direction. In one horizontal scanning period, the pixel circuits driven by the first data line driving circuit 32A are half of the pixel circuits arranged in the scanning line direction. Therefore, the amplifier unit 54 may be configured by 1944×3=9=2=324 amplifiers, and each of the amplifiers may be output nine times. Note that, the estimation of the number of amplifiers is set to 1944 instead of 1920 because it is set slightly larger than the display standard, and is set to the number that can be divided by 9.

The timing control circuit 34A includes a logic circuit 60 configured to control various timings such as vertical synchronization and horizontal synchronization, a look-up table data storage ROM 62, a look-up table load RAM 64, and a command ROM 66 that stores initial values of commands. A logic circuit is, for example, a gate array, and is denoted as "G/A" in FIG. 2. Similarly, the look-up table data storage ROM is denoted as "LUT_ROM", the look-up table load RAM is denoted as "LUT_RAM", and the command ROM is denoted as "Com_ROM", respectively.

The LUT_ROM 62 stores a plurality of types of table data indicating look-up tables for R, G, and B. Among the plurality of types of table data stored in the LUT_ROM 62, any one of the table data corresponding to R and any one of the table data corresponding to B are read out to the LUT_RAM 64 to be used when converting the RGB data. Similarly, among the plurality of types of table data stored in the LUT_ROM 62 of the timing control circuit 34B, any one of the table data corresponding to G and any one of the table data corresponding to B are read out to the LUT_RAM 64 of the timing control circuit 34B to be used when converting the RGB data. Note that, only the tail data for R and B may be stored in the LUT_ROM 62 of the timing control circuit 34A, and only the tail data for G and B may be stored in the LUT_ROM 62 of the timing control circuit 34B. Even when the data stored in the respective LUT_ROMs 62 of the timing control circuit 34A and the timing control circuit 34B are different, the automatic arrangement wiring of the G/A 60 can be dealt with independently.

The data stored in Com_ROM 66 may also be different between the timing control circuit 34A and the timing control circuit 34B. For example, when data for R, G, and B are stored in the LUT_ROM 62, different addresses may be stored in the Com_ROM 66 of the timing control circuit 34A and the Com_ROM 66 of the timing control circuit 34B as the data selection addresses from the LUT_ROM 62. As described above, by disposing the LUT_ROM 62 and the Com_ROM 66 in each of the timing control circuits 34A and 34B, changes according to the color of each of R, G, and B can be performed by only changing the ROM data, without changing the logic. The change of the ROM data does not affect the automatic arrangement wiring and timing feedback. Therefore, in the present exemplary embodiment, the display color of the display unit 10 can be easily adjusted even after the automatic arrangement wiring and the timing feedback.

As illustrated in FIG. 1, in the silicon backplane 2 of the present exemplary embodiment, the arrangement of each circuit in the first circuit region 30A and the arrangement of each circuit in the second circuit region 30B are in line symmetry by interposing the display unit 10, that is, in line symmetry with respect to a line AA' perpendicular to the data line and equally dividing the display unit 10 in the vertical direction. Further, although detailed illustration is omitted in FIG. 1, the arrangement of the transistors configuring each circuit in the first circuit region 30A and the arrangement of the transistors configuring each circuit in the second circuit region 30B are also in line symmetry with respect to the line AA', the wiring in the first circuit region 30A and the wiring in the second circuit region 30B are also in line symmetry with respect to the line AA'. Hereinafter, the circuit arrangement, the arrangement of the transistors configuring each circuit, and the wiring will be collectively referred to as "layout". The layout of the first circuit region 30A and the layout of the second circuit region 30B are in line symmetry to each other, thus, the layout of the first data line driving circuit 32A and the layout of the second data line driving circuit 32B are also in line symmetry with each other in the silicon backplane 2 of the present exemplary embodiment. The layout of the first data line driving circuit 32A and the layout of the second data line driving circuit 32B being in line symmetry to each other, means that, the arrangement of the transistors configuring the first data line driving circuit 32A and the arrangement of the transistors configuring the second data line driving circuit 32B are in line symmetry to each other, and the wiring in the first data line driving circuit 32A and the wiring in the second data line driving circuit 32B are in line symmetry to each other.

Figure 3:
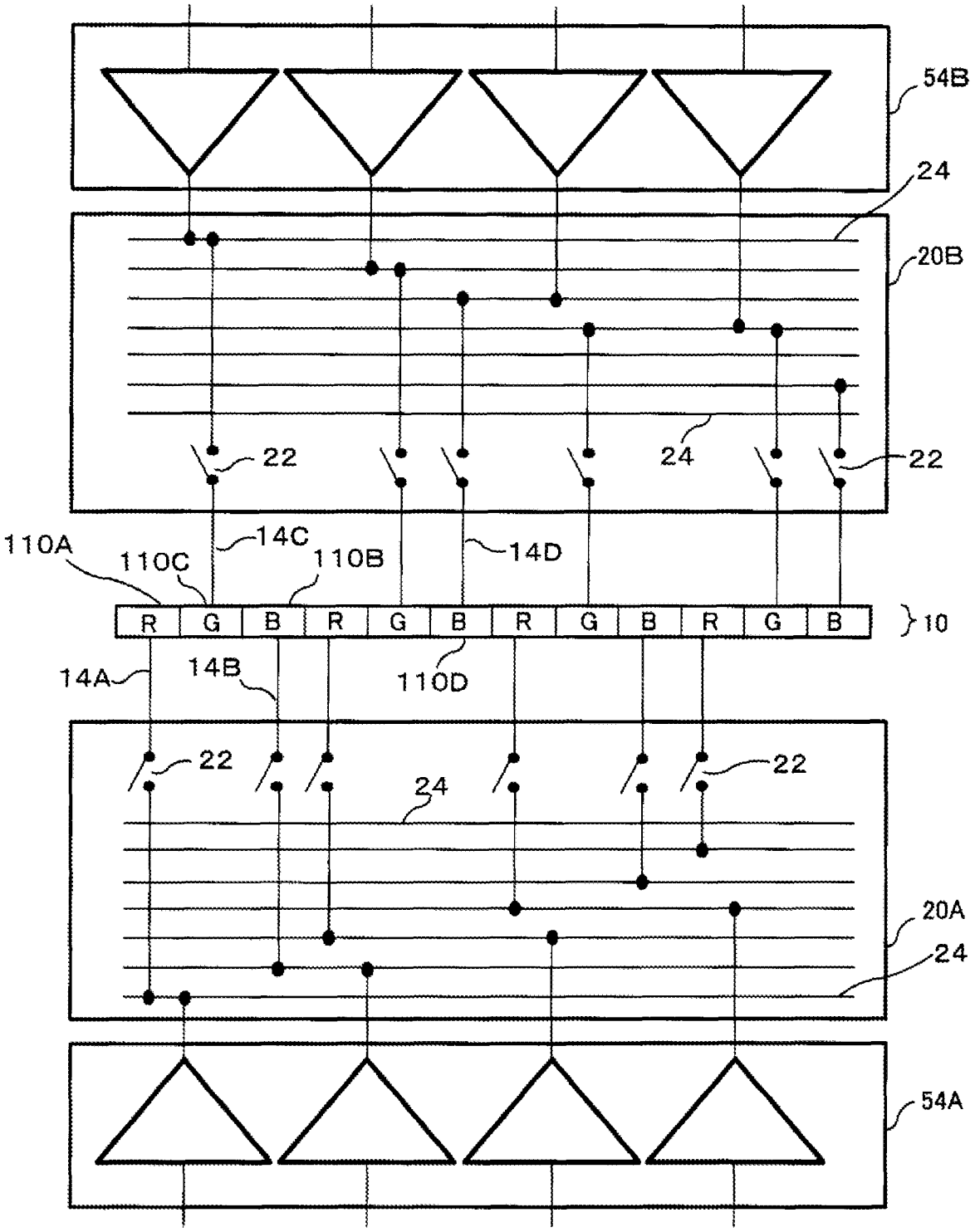
FIG. 3 is a diagram illustrating a configuration example of the first connection unit 20A and the second connection unit 20B.

FIG. 3 is a diagram illustrating a configuration of the first connection unit 20A and the second connection unit 20B. In addition to the first connection unit 20A and the second connection unit 20B, FIG. 3 also illustrates the display unit 10, the amplifier unit 54 of the first data line driving circuit 32A, and the amplifier unit 54 of the second data line driving circuit 32B. In FIG. 3, among the pixel circuits configuring the display unit 10, the pixel circuit with red display color is denoted as "R", the pixel circuit with green display color is denoted as "G", and the pixel circuit with blue display color is denoted as "B". In addition, in FIG. 3, a code "54A" is assigned to the amplifier 54 of the first data line driving circuit 32A, and a code "54B" is assigned to the amplifier 54 of the second data line driving circuit 32B. The first connection unit 20A includes 324 wirings 24 connected to each of the 324 amplifiers included in the amplifier unit 54A one by one, and switches 22 for switching the connection between each of the 1920×3=2=2880 data lines corresponding to each of the half of the pixel circuits arranged in the scanning line direction and the 324 wirings 24 described above. The half of the pixel circuits arranged in the scanning line direction are, for example, half of the pixel circuits with blue emission color and the pixel circuits with red emission color.

Similarly, the second connection unit 20B includes 324 wirings 24 connected to each of the 324 amplifiers included in the amplifier unit 54B one by one, and switches 22 for switching the connection between each of the 2880 data lines corresponding to half of the pixel circuits arranged in the scanning line direction and the 324 lines 24 described above. The half of the pixel circuits arranged in the scanning line direction are, for example, the other half of the pixel circuits with blue emission color and the pixel circuits with green emission color. As described above, the layout of the first data line driving circuit 32A and the layout of the second data line driving circuit 32B are in line symmetry. Therefore, as illustrated in FIG. 3, the layout of the amplifier unit 54A and the layout of the amplifier unit 54B are also in line symmetry. On the other hand, as illustrated in FIG. 3, the arrangement of each switch in the first connection unit 20A and the way of drawing out the wiring from each switch, and the arrangement of each switch in the second connection unit 20B and the way of drawing out the wiring from each switch are not in line symmetry to each other. That is, the layout of the first connection unit 20A and the layout of the second connection unit 20B are not in line symmetry, instead of being in line symmetry to each other with interposing the display unit 10. The reason why the layout of the first connection unit 20A and the layout of the second connection unit 20B are not in line symmetry is as follows.

The pixel circuits driven by the first data line driving circuit 32A and the pixel circuits driven by the second data line driving circuit 32B belong to different groups, and the arrangement of the pixel circuits belonging to the first group and the pixel circuit belonging to the second group is not in line symmetry with respect to the line AA'. Therefore, if the first connection unit 20A and the second connection unit 20B are not provided, it is difficult to lay out the first circuit region 30A and the second circuit region 30B in line symmetry including the wiring to the pixel circuit, and it is also difficult to lay out the first data line driving circuit 32A and the second data line driving circuit 32B be in line symmetry to each other. In the present exemplary embodiment, the asymmetry of the wiring to the pixel circuit is reflected in the first connection unit 20A and the second connection unit 20B, thus, the first circuit region 30A and the second circuit region 30B may be laid out in line symmetry, and the first data line driving circuit 32A and the second data line driving circuit 32B may be arranged in line symmetry. This is the reason why the layout of the first connection unit 20A and the layout of the second connection unit 20B are not in line symmetry.

In the present exemplary embodiment, since the layouts of the first circuit region 30A and the second circuit region 30B are in line symmetry to each other, it is not necessary to individually create layouts for each of the first circuit region 30A and the second circuit region 30B, it may be only one layout created for the first circuit region 30A and the second circuit region 30B. Therefore, the silicon backplane 2 of the small electro-optical device capable of displaying a high-definition image can be created by the same man-hours as that of the silicon backplane in the related art. In addition, it is not necessary to individually set various timings in the timing control circuit 34A or 34B in the first circuit region 30A and the second circuit region 30B. Furthermore, even in a case where feedback to the timing adjustment and the layout are required due to the influence of the wiring capacitance by the automatic arrangement wiring, the man-hours required for the feedback, and the man-hours of test verification are only one circuit region as that in the related art, and the design man-hours does not significantly increase.

When the I/O terminals are arranged in line symmetry with interposing the display unit 10 in the Y direction as in the present exemplary embodiment, it is necessary to individually create the FPC connected to each I/O terminal, that is, two types of FPC. In order to save the trouble of creating two types of Flexible Printed Circuits (FPC), it is conceivable to arrange the first circuit region 30A and the second circuit region 30B in point symmetry. However, in such a point-symmetric arrangement, when attention is paid to one column, the distance from the pixel of red emission color to the first power source, and the distance from the pixel of green emission color where one dot is formed together with the pixel of red emission color to the second power source are different from each other, it is assumed that display unevenness is easily to occur. Therefore, as in the present exemplary embodiment, it is preferable that the built-in power source in the first circuit region 30A and the built-in power source in the second circuit region 30B are laid out closer to one end of the scanning line in the wiring direction while being in line symmetry to each other by interposing display unit 10 in the wiring direction of the data line.

As described above, according to the present exemplary embodiment, a small electro-optical device capable of displaying a high-definition image and hardly causing display unevenness, without causing a significant increase in design man-hours can be developed.

B. Modification Example

Although one exemplary embodiment of the present invention has been described above, the following modification examples may be added to this exemplary embodiment. That is, in the exemplary embodiment described above, the layout of the first circuit region 30A and the layout of the second circuit region 30B are in line symmetry with respect to each other, however, at least the first data line driving circuit 32A and the second data line driving circuit 32B may be laid out in line symmetry. As described above, when the first power source (that is, the built-in power source arranged in the first circuit region 30A) configured to supply the operating voltage to the first data line driving circuit 32A and the second power source (that is, the built-in power source arranged in the second circuit region 30B) configured to supply the operating voltage to the second data line driving circuit 32B are arranged point-symmetrically, it is considered that display unevenness is easily to occur. However, in a case where priority is given to reduce the man-hours of creating of the FPC rather than reducing such display unevenness, the first power source and the second power source may be arranged point-symmetrically. Further, although the exemplary embodiment described above has described an example of application to the electro-optical device using the OLED, the invention may be applied to an electro-optical device using liquid crystal.

C. Application Example

The electro-optical device according to the exemplary embodiment described above can be applied to various electronic apparatuses, and is particularly suitable for an electronic apparatus that is required to display a high-definition image of 2K 2K or more and is required to be compact. An electronic apparatus according to the present invention will be described below.

Figure 4:
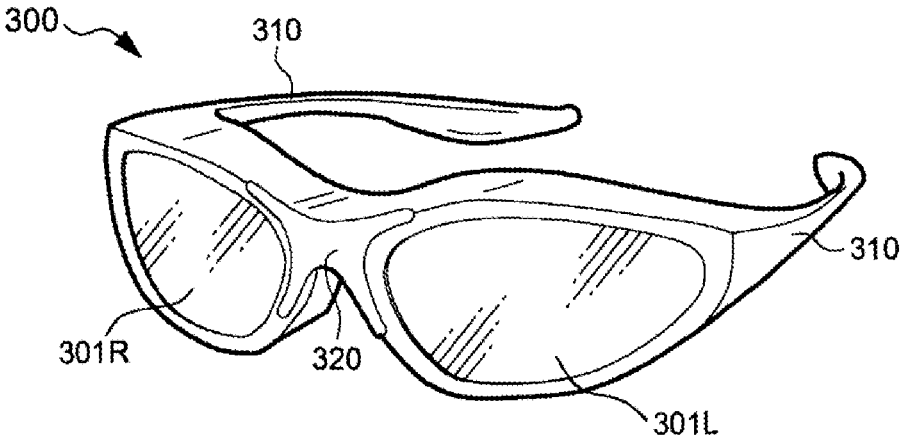
FIG. 4 is a perspective view of the head mounted display 300 according to the present invention.

FIG. 4 is a perspective view illustrating the appearance of a head mounted display 300 as an electronic apparatus adopting the electro-optical device 1 according to the present invention. As illustrated in FIG. 4, the head mounted display 300 includes a temple 310, a bridge 320, a projection optical system 301L, and a projection optical system 301R. And, in FIG. 4, an electro-optical device (not illustrated) for the left eye is provided behind the projection optical system 301L, and an electro-optical device (not illustrated) for the right eye is provided behind the projection optical system 301R.

Figure 5:
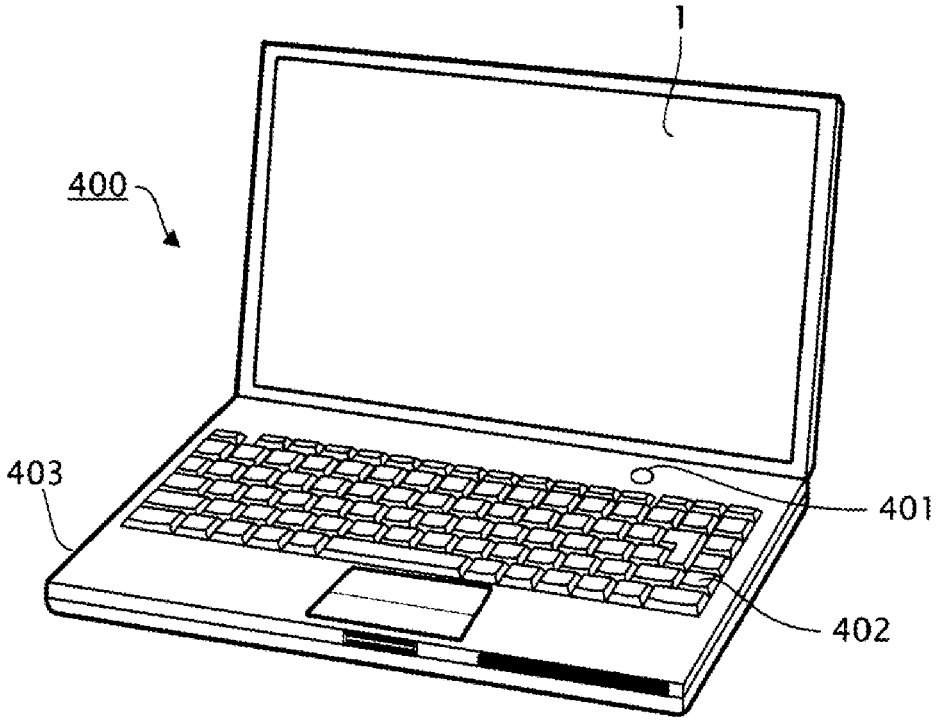
FIG. 5 is a perspective view of the personal computer 400 according to the present invention.

FIG. 5 is a perspective view of a portable personal computer 400 adopting the electro-optical device 1 according to the present invention. The personal computer 400 includes an electro-optical device 1 that displays various images, and a main body portion 403 provided with a power switch 401 and a keyboard 402. Note that, in addition to the example devices illustrated in FIG. 4 and FIG. 5, the electronic apparatus to which the electro-optical device 1 according to the present invention is applied include a mobile phone, a smart-phone, a personal digital assistant (PDA), a digital still camera, and a video camera. Other, the electronic apparatus to which the electro-optical device according to the invention is applied include a television, a car navigation device, a display device (instrument panel) for in-vehicle use, an electronic organizer, an electronic paper, an electronic calculator, a word processor, a workstation, a visual telephone, a POS terminal, and the like. Further, the electro-optical device according to the present invention can be applied as a display unit provided in an electronic apparatus such as a printer, a scanner, a copying machine, a video player, and the like.

The entire disclosure of Japanese Patent Application No. 2018-010421, filed Jan. 25, 2018 is expressly incorporated by reference herein.

What is claimed is:

1. An electro-optical device comprising:

a display unit provided with a first pixel circuit connected to a first data line, a second pixel circuit connected to a second data line, a third pixel circuit connected to a third data line, and a fourth pixel circuit connected to a fourth data line;

a first data line driving circuit configured to supply a gradation signal corresponding to a display gradation to the first data line and the second data line; and a second data line driving circuit configured to supply a gradation signal corresponding to a display gradation to the third data line and the fourth data line, wherein the first data line driving circuit and the second data line driving circuit are arranged to sandwich the display unit in a wiring direction of the first data line, and a layout of the first data line driving circuit and a layout of the second data line driving circuit are in line symmetry, and the first, second, third and fourth pixel circuits are connected along a line in a direction perpendicular to the wiring direction, the first data line driving circuit includes a first plurality of transistors and a first plurality of wirings, the second data line driving circuit includes a second plurality of transistors and a second plurality of wirings, the first plurality of transistors and the second plurality of transistors are in line symmetry with each other with respect to the line, and the first plurality of wirings and the second plurality of wirings are in line symmetry with each other with respect to the line.

2. The electro-optical device according to claim 1, further comprising:

a first connection unit that connects the first data line and the second data line with the first data line driving circuit; and a second connection unit that connects the third data line and the fourth data line with the second data line driving circuit, wherein a layout of the first connection unit and a layout of the second connection unit are not in line symmetry.

3. The electro-optical device according to claim 1, further comprising:

a first power source configured to supply an operating voltage to the first data line driving circuit; and a second power source configured to supply an operating voltage to the second data line driving circuit, wherein the first power source and the second power source are arranged to sandwich the display unit in the wiring direction of the first data line, and a layout of the first power source and a layout of the second power source are in line symmetry.

4. An electro-optical device comprising:

a display unit provided with a first pixel circuit connected to a first data line, a second pixel circuit connected to a second data line, a third pixel circuit connected to a third data line, and a fourth pixel circuit connected to a fourth data line;

a first circuit region that includes at least a first data line driving circuit configured to supply a gradation signal corresponding to a display gradation to the first data line and the second data line; and a second circuit region that includes at least a second data line driving circuit configured to supply a gradation signal corresponding to a display gradation to the third data line and the fourth data line, wherein the first circuit region and the second circuit region are arranged to sandwich the display unit in a wiring direction of the first data line, and a layout of the first data line driving circuit and a layout of the second data line driving circuit are in line symmetry, and the first, second, third and fourth pixel circuits are connected along a line in a direction perpendicular to the wiring direction, the first data line driving circuit includes a first plurality of transistors and a first plurality of wirings, the second data line driving circuit includes a second plurality of transistors and a second plurality of wirings, the first plurality of transistors and the second plurality of transistors are in line symmetry with each other with respect to the line, and the first plurality of wirings and the second plurality of wirings are in line symmetry with each other with respect to the line.

5. The electro-optical device according to claim 4, wherein a layout of the first circuit region and a layout of the second circuit region are in line symmetry.

6. The electro-optical device according to claim 4, further comprising:

a first power source configured to supply an operating voltage to the first data line driving circuit, the first power source being provided in the first circuit region; and a second power source configured to supply an operating voltage to the second data line driving circuit, the second power source being provided in the second circuit region, wherein the first power source and the second power source are arranged to sandwich the display unit in the wiring direction of the first data line, and a layout of the first power source and a layout of the second power source are in line symmetry.

7. An electronic apparatus comprising:

the electro-optical device according to claim 1.

8. An electronic apparatus comprising:

the electro-optical device according to claim 4.

* * * * *